US008577673B2

(12) United States Patent
Gao

(10) Patent No.: US 8,577,673 B2
(45) Date of Patent: Nov. 5, 2013

(54) CELP POST-PROCESSING FOR MUSIC SIGNALS

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 1086 days.

(21) Appl. No.: 12/559,739

(22) Filed: Sep. 15, 2009

(65) Prior Publication Data

US 2010/0070270 A1 Mar. 18, 2010

Related U.S. Application Data

(60) Provisional application No. 61/096,908, filed on Sep. 15, 2008.

(51) Int. Cl.
*G10L 21/00* (2013.01)

(52) U.S. Cl.
USPC ..... 704/207; 704/201; 704/208; 704/216; 704/217; 704/219

(58) Field of Classification Search
USPC ..... 704/207, 201, 208, 216, 217, 219, 223
See application file for complete search history.

(56) References Cited

U.S. PATENT DOCUMENTS

| | | | | |
|---|---|---|---|---|
| 5,828,996 | A | 10/1998 | Iijima et al. | |
| 5,974,375 | A | 10/1999 | Aoyagi et al. | |
| 6,018,706 | A | 1/2000 | Huang et al. | |
| 6,507,814 | B1 * | 1/2003 | Gao | 704/220 |
| 6,629,283 | B1 | 9/2003 | Toyama | |
| 6,708,145 | B1 | 3/2004 | Liljeryd et al. | |
| 7,216,074 | B2 | 5/2007 | Malah et al. | |
| 7,328,160 | B2 | 2/2008 | Nishio et al. | |
| 7,328,162 | B2 | 2/2008 | Liljeryd et al. | |
| 7,359,854 | B2 | 4/2008 | Nilsson et al. | |
| 7,433,817 | B2 | 10/2008 | Kjörling et al. | |

(Continued)

FOREIGN PATENT DOCUMENTS

WO WO 2007/087824 A1 8/2007

OTHER PUBLICATIONS

"G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, International Telecommunication Union, ITU-T Recommendation G.729. May 1, 2006, 100 pages.

(Continued)

*Primary Examiner* — Vincent P Harper
(74) *Attorney, Agent, or Firm* — Slater & Matsil, L.L.P.

(57) ABSTRACT

In one embodiment, a method of receiving a decoded audio signal that has a transmitted pitch lag is disclosed. The method includes estimating pitch correlations of possible short pitch lags that are smaller than a minimum pitch limitation and have an approximated multiple relationship with the transmitted pitch lag, checking if one of the pitch correlations of the possible short pitch lags is large enough compared to a pitch correlation estimated with the transmitted pitch lag, and selecting a short pitch lag as a corrected pitch lag if a corresponding pitch correlation is large enough. The postprocessing is performed using the corrected pitch lag. In another embodiment, when the existence of irregular harmonics or wrong pitch lag is detected, a coded-excited linear prediction (CELP) postfilter is made more aggressive.

20 Claims, 4 Drawing Sheets

(56) References Cited

U.S. PATENT DOCUMENTS

| | | | | |
|---|---|---|---|---|
| 7,447,631 | B2 | 11/2008 | Truman et al. | |
| 7,469,206 | B2 | 12/2008 | Kjörling et al. | |
| 7,546,237 | B2 | 6/2009 | Nongpiur et al. | |
| 7,627,469 | B2 | 12/2009 | Nettre et al. | |
| 7,752,038 | B2 * | 7/2010 | Laaksonen et al. | 704/207 |
| 2002/0002456 | A1 | 1/2002 | Vainio et al. | |
| 2003/0093278 | A1 | 5/2003 | Malah | |
| 2003/0200092 | A1 | 10/2003 | Gao et al. | |
| 2004/0015349 | A1 | 1/2004 | Vinton et al. | |
| 2004/0181397 | A1 | 9/2004 | Gao | |
| 2004/0225505 | A1 | 11/2004 | Andersen et al. | |
| 2005/0159941 | A1 | 7/2005 | Kolesnik et al. | |
| 2005/0165603 | A1 * | 7/2005 | Bessette et al. | 704/200.1 |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0255559 | A1 | 11/2007 | Gao et al. | |
| 2007/0282603 | A1 | 12/2007 | Bessette | |
| 2007/0299662 | A1 | 12/2007 | Kim et al. | |
| 2007/0299669 | A1 | 12/2007 | Ehara | |
| 2008/0010062 | A1 | 1/2008 | Son et al. | |
| 2008/0027711 | A1 | 1/2008 | Rajendran et al. | |
| 2008/0052066 | A1 | 2/2008 | Oshikiri et al. | |
| 2008/0052068 | A1 | 2/2008 | Aguilar et al. | |
| 2008/0091418 | A1 | 4/2008 | Laaksonen et al. | |
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2009/0024399 | A1 | 1/2009 | Gartner et al. | |
| 2009/0125301 | A1 * | 5/2009 | Master et al. | 704/208 |
| 2009/0254783 | A1 | 10/2009 | Hirschfeld et al. | |
| 2010/0063802 | A1 | 3/2010 | Gao | |
| 2010/0063803 | A1 | 3/2010 | Gao | |
| 2010/0063810 | A1 | 3/2010 | Gao | |
| 2010/0063827 | A1 | 3/2010 | Gao | |
| 2010/0070269 | A1 | 3/2010 | Gao | |
| 2010/0121646 | A1 | 5/2010 | Ragot et al. | |
| 2010/0211384 | A1 * | 8/2010 | Qi et al. | 704/207 |
| 2010/0292993 | A1 | 11/2010 | Vaillancourt et al. | |

OTHER PUBLICATIONS

International Search Report and Written Opinion, International application No. PCT/US2009/056981, Date of mailing Nov. 2, 2009, 11 pages.

International Search Report and Written Opinion, International Application No. PCT/US2009/056111, GH Innovation, Inc. Date of Mailing Oct. 23, 2009, 13 pgs.

International Search Report and Written Opinion, International Application No. PCT/US2009/056106, Huawei Technologies Co., Ltd., Date of Mailing Oct. 19, 2009, 11 pgs.

International Search Report and Written Opinion, International Application No. PCT/US2009/056113, Huawei Technologies Co., Ltd., Date of Mailing Oct. 22, 2009, 10 pgs.

International Search Report and Written Opinion, International Application No. PCT/US2009/056117, GH Innovation, Inc., Date of Mailing Mailing Oct. 19, 2009, 8 pgs.

International Search Report and Written Opinion, International Application No. PCT/US2009/056860, Huawei Technologies Co., LTD., Inc., Date of Mailing Oct. 26, 2009, 11 pgs.

* cited by examiner

CELP POST-PROCESSING FOR MUSIC SIGNALS

CROSS REFERENCE TO RELATED APPLICATIONS

This patent application claims priority to U.S. Provisional Application No. 61/096,908 filed on Sep. 15, 2008, entitled "Improving CELP Post-Processing for Music Signals," which application is hereby incorporated by reference herein.

TECHNICAL FIELD

This invention is generally in the field of speech/audio coding, and more particularly related to coded-excited linear prediction (CELP) coding for music signal and singing signal.

BACKGROUND

CELP is a very popular technology which is used to encode a speech signal by using specific human voice characteristics or a human vocal voice production model. When CELP is used in a core layer of a scalable codec, it is quite possible that CELP will also be used to code music signal. Examples of CELP implementations with scalable transform coding can be found in the ITU-T G.729.1 or G.718 standards, the related contents of which are summarized hereinbelow. A very detailed description can be found in the ITU-T standard documents.

General Description of ITU-T G.729.1

ITU-T G.729.1 is also called a G.729EV coder which is an 8-32 kbit/s scalable wideband (50-7,000 Hz) extension of ITU-T Rec. G.729. By default, the encoder input and decoder output are sampled at 16,000 Hz. The bitstream produced by the encoder is scalable and has 12 embedded layers, which will be referred to as Layers 1 to 12. Layer 1 is the core layer corresponding to a bit rate of 8 kbit/s. This layer is compliant with the G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

This coder is designed to operate with a digital signal sampled at 16,000 Hz followed by conversion to 16-bit linear PCM for the input to the encoder. However, the 8,000 Hz input sampling frequency is also supported. Similarly, the format of the decoder output is 16-bit linear PCM with a sampling frequency of 8,000 or 16,000 Hz. Other input/output characteristics are converted to 16-bit linear PCM with 8,000 or 16,000 Hz sampling before encoding, or from 16-bit linear PCM to the appropriate format after decoding.

The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2 which yield a narrowband synthesis (50-4,000 Hz) at 8 kbit/s and 12 kbit/s. The TDBWE stage generates Layer 3 and allows producing a wideband output (50-7000 Hz) at 14 kbit/s. The TDAC stage operates in the Modified Discrete Cosine Transform (MDCT) domain and generates Layers 4 to 12 to improve quality from 14 to 32 kbit/s. TDAC coding represents jointly the weighted CELP coding error signal in the 50-4,000 Hz band and the input signal in the 4,000-7,000 Hz band.

The G.729EV coder operates on 20 ms frames. However, the embedded CELP coding stage operates on 10 ms frames, like G.729. As a result, two 10 ms CELP frames are processed per 20 ms frame. In the following, to be consistent with the text of ITU-T Rec. G.729, the 20 ms frames used by G.729EV will be referred to as superframes, whereas the 10 ms frames and the 5 ms subframes involved in the CELP processing will be respectively called frames and subframes.

G729.1 Encoder

A functional diagram of the G729.1 encoder part is presented in FIG. 1. The encoder operates on 20 ms input superframes. By default, input signal 101, $s_{WB}(n)$, is sampled at 16,000 Hz., therefore, the input superframes are 320 samples long. Input signal $s_{WB}(n)$ is first split into two sub-bands using a quadrature mirror filterbank (QMF) defined by the filters $H_1(z)$ and $H_2(z)$. Lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbit/s is processed by the perceptual weighting filter $W_{LB}(z)$. The parameters of $W_{LB}(z)$ are derived from the quantized LP coefficients of the CELP encoder. Furthermore, the filter $W_{LB}(z)$ includes a gain compensation that guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with a 3,000 Hz cut-off frequency. Resulting signal $s_{HB}(n)$ is coded by the TDBWE encoder. The signal $s_{HB}(n)$ is also transformed into the frequency domain by MDCT. The two sets of MDCT coefficients, 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improved quality in the presence of erased superframes.

G729.1 Decoder

A functional diagram of the G729.1 decoder is presented in FIG. 2*a*, however, the specific case of frame erasure concealment is not considered in this figure. The decoding depends on the actual number of received layers or equivalently on the received bit rate. If the received bit rate is:

- 8 kbit/s (Layer 1): The core layer is decoded by the embedded CELP decoder to obtain 201, $\hat{s}_{LB}(n)=\hat{s}(n)$. Then, $\hat{s}_{LB}(n)$ is postfiltered into 202, $\hat{s}_{LB}^{post}(n)$ and post-processed by a high-pass filter (HPF) into 203, $\hat{s}_{LB}^{qmf}(n)=\hat{s}_{LB}^{hpf}(n)$. The QMF synthesis filterbank defined by the filters $G_1(z)$ and $G_2(z)$ generates the output with a high-frequency synthesis 204, $\hat{s}_{HB}^{qmf}(n)$, set to zero.
- 12 kbit/s (Layers 1 and 2): The core layer and narrowband enhancement layer are decoded by the embedded CELP decoder to obtain 201, $\hat{s}_{LB}(n)=\hat{s}_{enh}(n)$, and $\hat{s}_{LB}(n)$ is then postfiltered into 202, $\hat{s}_{LB}^{post}(n)$ and high-pass filtered to obtain 203, $\hat{s}_{LB}^{qmf}(n)=\hat{s}_{LB}^{hpf}(n)$. The QMF synthesis filterbank generates the output with a high-frequency synthesis 204, $\hat{s}_{HB}^{qmf}(n)$ set to zero.
- 14 kbit/s (Layers 1 to 3): In addition to the narrowband CELP decoding and lower-band adaptive postfiltering, the TDBWE decoder produces a high-frequency synthesis 205, $\hat{s}_{HB}^{bwe}(n)$ which is then transformed into frequency domain by MDCT so as to zero the frequency band above 3000 Hz in the higher-band spectrum 206, $\hat{S}_{HB}^{bwe}(k)$. The resulting spectrum 207, $\hat{S}_{HB}(k)$ is transformed in time domain by inverse MDCT and overlap-add before spectral folding by $(-1)^n$. In the QMF synthesis filterbank the reconstructed higher band signal 204, $\hat{s}_{HB}^{qmf}(n)$ is combined with the respective lower band signal 202, $\hat{s}_{LB}^{qmf}(n)=\hat{s}_{LB}^{post}(n)$. reconstructed at 12 kbit/s without high-pass filtering.

Above 14 kbit/s (Layers 1 to 4+): In addition to the narrowband CELP and TDBWE decoding, the TDAC decoder reconstructs MDCT coefficients 208, $\hat{D}_{LB}^{w}(k)$ and 207, $\hat{S}_{HB}(k)$, which correspond to the reconstructed weighted difference in lower band (0-4,000 Hz) and the reconstructed signal in higher band (4,000-7,000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^{w}(k)$ and $\hat{S}_{HB}(k)$ are transformed into the time domain by inverse MDCT and overlap-add. Lower-band signal 209, $\hat{d}_{LB}^{w}(n)$ is then processed by the inverse perceptual weighting filter $W_{LB}(z)^{-1}$. To attenuate transform coding artefacts, pre/post-echoes are detected and reduced in both the lower- and higher-band signals 210, a $\hat{d}_{LB}(n)$ and 211, $\hat{s}_{HB}(n)$. The lower-band synthesis $\hat{s}_{LB}(n)$ is postfiltered, while the higher-band synthesis 212, $\hat{s}_{HB}^{fold}(n)$, is spectrally folded by $(-1)^n$. The signals $\hat{s}_{LB}(n)=\hat{s}_{LB}^{post}(n)$ and $\hat{s}_{HB}^{qmf}(n)$ are then combined and upsampled in the QMF synthesis filterbank.

Coder Modes

The G.729.1 coder, also known as the G.729EV coder is based on a split-band coding approach that naturally yields a very flexible architecture. This coder can easily deal with input and output signals sampled not only at 16,000 Hz, but also at 8,000 Hz by taking advantage of QMF analysis and synthesis filterbanks Table 1 lists the available modes in G.729EV. The DEFAULT mode of G.729EV corresponds to the default operation mode of G.729EV, in which case input and output signals are sampled at 16,000 Hz.

TABLE 1

G.729.1 Encoder/Decoder Modes

| Mode | Encoder Operation | Decoder Operation |
|---|---|---|
| DEFAULT | 16,000 Hz input | 16,000 Hz Output |
| NB_INPUT | 8.000 Hz input | N/A |
| G729_BST | bit rate limited to 8 kbit/s, output G.729 bitstream | N/A |

TABLE 1-continued

G.729.1 Encoder/Decoder Modes

| Mode | Encoder Operation | Decoder Operation |
|---|---|---|
| NB_OUTPUT | N/A | 8,000 Hz output |
| G729B_BST | N/A | read and decode G729B bitstream |
| LOW_DELAY | N/A | bit rate limited to 8-12 kbit/s, low delay. |

Two additional encoder modes are provided:

The NB INPUT mode specifies that the encoder input is sampled at 8,000 Hz, which allows the bypassing of the QMF analysis filterbank; and In G729 BST mode, the encoder runs at 8 kbit/s and generates a bitstream with G.729 format using 10 ms frames. The encoder input is sampled at 16,000 Hz by default. If the NB INPUT mode is also set, this input is sampled at 8,000 Hz.

On the other hand, three decoder modes are also available:

The NB_OUTPUT mode specifies that the decoder output is sampled at 8,000 Hz, which allows the bypassing of the QMF synthesis filterbank;

In G729B_BST mode the decoder reads and decodes G729B frames; and

The LOW_DELAY mode is provided for narrowband use cases. In this case, the decoder bit rate is limited to 8-12 kbit/s, which allows the reduction of the overall algorithmic delay by skipping the inverse MDCT and overlap-add.

In G729B_BST or LOW_DELAY modes, the decoder output is sampled at 16,000 Hz by default. If the NB_OUTPUT mode is also set, the decoder output is sampled at 8,000 Hz. Note that the LOW_DELAY decoder mode has not been formally tested in the presence of frame erasures.

Bit Allocation to Coder Parameters and Bitstream Layer Format

The bit allocation of the coder is presented in Table 2. This table is structured according to the different layers. For a given bit rate, the bitstream is obtained by concatenating the contributing layers. For example, at 24 kbit/s, which corresponds to 480 bits per superframe, the bitstream comprises Layer 1 (160 bits)+Layer 2 (80 bits)+Layer 3 (40 bits)+Layer 4 to 8 (200 bits).

The G.729EV bitstream format is illustrated in FIG. 2*b*. Since the TDAC coder employs spectral envelope entropy coding and adaptive sub-band bit allocation, the TDAC parameters are encoded with a variable number of bits. However, the bitstream above 14 kbit/s can be still formatted into layers of 2 kbit/s, because the TDAC encoder always performs a bit allocation on the basis of the maximum encoder bitrate (32 kbit/s), and the TDAC decoder can handle bitstream truncations at arbitrary positions.

TABLE 2

G.729 Bit Allocation (per 20 ms superframe)

| Parameter | Codeword | Number of Bits | | | | Total Per Super-frame |
|---|---|---|---|---|---|---|
| Layer 1 - Core layer (narrowband embedded CELP) | | | | | | |
| | | 10 ms frame 1 | | 10 ms frame 2 | | |
| Line spectrum pairs | L0, L1, L2, L3 | 18 | | 18 | | 36 |
| | | subframe 1 | subframe 2 | subframe 1 | subframe 2 | |
| Adaptive-codebook delay | P1, P2 | 8 | 5 | 8 | 5 | 26 |
| Pitch-delay parity | P0 | 1 | | 1 | | 2 |

TABLE 2-continued

| G.729 Bit Allocation (per 20 ms superframe) | | | | | | |
|---|---|---|---|---|---|---|
| Parameter | Codeword | Number of Bits | | | | Total Per Super-frame |
| Fixed-codebook index | C1, C2 | 13 | 13 | 13 | 13 | 52 |
| Fixed-codebook sign | S1, S2 | 4 | 4 | 4 | 4 | 16 |
| Codebook gains (stage 1) | GA1, GA2 | 3 | 3 | 3 | 3 | 12 |
| Codebook gains (stage 2) | GB1, GB2 | 4 | 4 | 4 | 4 | 16 |
| 8 kbit/s core total | | | | | | 160 |
| Layer 2 - Narrowband Enhancement Layer (embedded CELP) | | | | | | |
| 2nd Fixed-codebook index | C'1, C'2 | 13 | 13 | 13 | 13 | 52 |
| 2nd Fixed-codebook sign | S'1, S'2 | 4 | 4 | 4 | 4 | 16 |
| 2nd Fixed-codebook gain | G'1, G'2 | 3 | 2 | 3 | 2 | 10 |
| FEC bits (class information) | CL1, CL2 | | 1 | | 1 | 2 |
| 12 kbit/s layer total | | | | | | 80 |
| Layer 3 - Wideband Enhancement Layer (TDBWE) | | | | | | |
| Time envelope mean | MU | 5 | | | | 5 |
| Time envelope VQ | T1, T2 | 7 + 7 | | | | 14 |
| Frequency envelope split VQ | F1, F2, F3 | 5 + 5 + 4 | | | | 14 |
| FEC bits (class information) | PH | 7 | | | | 7 |
| 14 kbit/s layer total | | | | | | 40 |
| Layesr 4-12 - Wideband Enhancement Layers (TDAC) | | | | | | |
| FEC bits (energy information) | E | 5 | | | | 5 |
| MDCT norm | N | 4 | | | | 4 |
| HB spectral envelope | RMS2 | variable number nbits_HB | | | | nbits_HB |
| LB spectral envelope | RMS1 | variable number nbits_LB | | | | nbits_LB |
| fine structure (VQ of sub-bands coefficients) | VQ1 to VQ18 | nbits_VQ = 351 − nbits_HB − nbits_LB | | | | nbits_VQ |
| 16-32 kbit/s layer total | | | | | | 360 |
| TOTAL | | | | | | 640 |

Post-Filtering of the Lower Band

As described in 4.2/G.729, the G.729 decoder includes a post-processing split into adaptive postfiltering, high-pass filtering and signal upscaling. Similarly, the G.729EV decoder includes lower-band post-processing. However, this procedure is limited to adaptive postfiltering and high-pass filtering. In the G.729EV decoder, signal upscaling is handled by the QMF synthesis filterbank. The adaptive postfilter in G.729EV is directly derived from the G.729 postfilter. It is also a cascade of three filters: a long-term postfilter $H_p(z)$, a short-term postfilter $H_f(z)$ and a tilt compensation filter $H_t(z)$, followed by an adaptive gain control procedure.

The postfilter coefficients are updated every 5 ms subframe. The postfiltering process is organized as follows. First, the reconstructed speech $\hat{s}(n)$ is inverse filtered through $\hat{A}(z/\gamma_n)$ to produce the residual signal $\hat{r}(n)$). This signal is used to compute the delay T and gain $g_t$ of the long-term postfilter $H_p(z)$. The signal $\hat{r}(n)$ is then filtered through the long-term postfilter $H_p(z)$ and the synthesis filter $1/[g_f\hat{A}(z/\gamma_d)]$. Finally, the output signal of the synthesis filter $1/[g_f\hat{A}(z/\gamma_d)]$ is passed through the tilt compensation filter $H_t(z)$ to generate the post-filtered reconstructed speech signal sf(n). Adaptive gain control is then applied to sf(n) to match the energy of $\hat{s}(n)$. The resulting signal sf'(n) is high-pass filtered and scaled to produce the output signal of the decoder. In the G.729EV decoder, the signal upscaling is handled by the QMF synthesis filterbank.

The long-term postfilter is given by:

$$H_p(z) = \frac{1}{1+\gamma_p g_l}(1+\gamma_p g_l z^{-T}) \tag{1}$$

where T is the pitch delay, the integer pitch range of T defined in G7.729 is from PIT_MIN=20 to PIT_MAX=143, and $g_l$ is the gain coefficient. Note that $g_l$ is bounded by 1 and is set to zero if the long-term prediction gain is less than 3 dB. The factor $\gamma_p$ controls the amount of long-term postfiltering and has the value of $\gamma_p$=0.5. The long-term delay and gain are computed from the residual signal $\hat{r}(n)$ obtained by filtering the speech $\hat{s}(n)$ through $\hat{A}(z/\gamma_n)$, which is the numerator of the short-term postfilter:

$$\hat{r}(n) = \hat{s}(n) + \sum_{i=1}^{10} \gamma_n^i \hat{a}_i \hat{s}(n-i) \tag{2}$$

The long-term delay is computed using a two-pass procedure. The first pass selects the best integer $T_0$ in the range $[\mathrm{int}(T_1)-1, \mathrm{int}(T_1)+1]$, where $\mathrm{int}(T_1)$ is the integer part of the (transmitted) pitch delay $T_1$ in the first subframe. The best integer delay is the one that maximizes the correlation:

$$R(k) = \sum_{n=0}^{39} \hat{r}(n)\hat{r}(n-k) \tag{3}$$

The second pass chooses the best fractional delay T with resolution ⅛ around $T_0$. This is done by finding the delay with the highest pseudo-normalized correlation:

$$R'(k) = \frac{\sum_{n=0}^{39} \hat{r}(n)\hat{r}_k(n)}{\sqrt{\sum_{n=0}^{39} \hat{r}_k(n)\hat{r}_k(n)}} \tag{4}$$

where $\hat{r}_k(n)$ is the residual signal at delay k. Once the optimal delay T is found, the corresponding correlation R'(T) is normalized with the square-root of the energy of $\hat{r}(n)$. The squared value of this normalized correlation is used to determine if the long-term postfilter should be disabled. This is done by setting $g_l$=0 if:

$$\frac{R'(T)^2}{\sum_{n=0}^{39} \hat{r}(n)\hat{r}(n)} < 0.5, \tag{5}$$

Otherwise the value of $g_l$ is computed from:

$$g_l = \frac{\sum_{n=0}^{39} \hat{r}(n)\hat{r}_k(n)}{\sum_{n=0}^{39} \hat{r}_k(n)\hat{r}_k(n)} \text{ bounded by } 0 \le gl \le 1.0. \tag{6}$$

The non-integer delayed signal $\hat{r}_k(n)$ is first computed using an interpolation filter of length 33. After the selection of T, $\hat{r}_k(n)$ is recomputed with a longer interpolation filter of length 129. The new signal replaces the previous signal only if the longer filter increases the value of R'(T).

The short-term postfilter is given by:

$$H_f(z) = \frac{1}{g_f}\frac{\hat{A}(z/\gamma_n)}{\hat{A}(z/\gamma_d)} = \frac{1}{g_f}\frac{1+\sum_{i=1}^{10}\gamma_n^i \hat{a}_i z^{-i}}{1+\sum_{i=1}^{10}\gamma_d^i \hat{a}_i z^{-i}}, \tag{7}$$

where $\hat{A}(z)$ is the received quantized LP inverse filter (LP analysis is not done at the decoder) and the factors $\gamma_n$ and $\gamma_d$ control the amount of short-term postfiltering, and are set to $\gamma_n$=0.55, and $\gamma_d$=0.7. The gain term $g_f$ is calculated on the truncated impulse response $h_f(n)$ of the filter $\hat{A}(z/\gamma_n)/\hat{A}(z/\gamma_d)$ and is given by:

$$g_f = \sum_{n=0}^{19} |h_f(n)|. \tag{8}$$

The filter $H_t(z)$ compensates for the tilt in the short-term postfilter $H_f(z)$ and is given by:

$$H_t(z) = \frac{1}{g_t}(1+\gamma_t k_1' z^{-1}), \tag{9}$$

where $\gamma_t k_1'$ is a tilt factor $k_1'$ being the first reflection coefficient calculated from $h_f(n)$ with:

$$k_1' = \frac{r_h(1)}{r_h(0)} \quad r_h(i) = \sum_{j=0}^{19-i} h_f(j)h_f(j+1) \tag{10}$$

The gain term $g_t=1-|\gamma_t k_1'|$ compensates for the decreasing effect of $g_f$ in $H_f(z)$. Furthermore, it has been shown that the product filter $H_f(z)H_t(z)$ has generally no gain. Two values for $\gamma_t$ are used depending on the sign of $k_1'$. If $k_1'$ is negative, $\gamma_t$=0.9, and if $k_1'$ is positive, $\gamma_t$=0.2.

Adaptive gain control is used to compensate for gain differences between the reconstructed speech signal $\hat{s}(n)$ and the postfiltered signal sf(n). The gain scaling factor G for the present subframe is computed by:

$$G = \frac{\sum_{n=0}^{39} |\hat{s}(n)|}{\sum_{n=0}^{39} |sf(n)|}. \tag{11}$$

The gain-scaled postfiltered signal sf'(n) is given by:

$$sf'(n) = g^{(n)} sf(n) \quad n=0, \ldots, 39 \tag{12}$$

where $g^{(n)}$ is updated on a sample-by-sample basis and given by:

$$g^{(n)} = 0.85 g^{(n-1)} + 0.15 G \quad n=0, \ldots, 39. \tag{13}$$

The initial value of $g^{(-1)}$=1.0 is used. Then for each new subframe, $g^{(-1)}$ is set equal to $g^{(39)}$ of the previous subframe.

A high-pass filter with a cut-off frequency of 100 Hz is applied to the reconstructed postfiltered speech sf'(n). The filter is given by:

$$H_{h2}(z) = \frac{0.93980581 - 1.8795834z^{-1} + 0.93980581z^{-2}}{1 - 1.9330735z^{-1} + 0.93589199z^{-2}}. \quad (14)$$

The filtered signal is multiplied by a factor 2 to restore the input signal level.

G.729 postprocessing is described above. Modifications in G.729.1 corresponding to the G.729 adaptive postfilter are:

- The parameters $\gamma_p$, $\gamma_n$, $\gamma_d$ of G.729 long-term and short-term postfilters depend on the decoder bit rate (8 or 12 kbit/s, or above);
- The G.729 adaptive gain control is modified to attenuate the quantization errors in silence segments (only at 8 and 12 kbit/s).

The values of $\gamma_p$, $\gamma_n$ and $\gamma_d$ of the long-term and short-term postfilters are given in Table 3. At 12 kbit/s, the values of $\gamma_n$ and $\gamma_d$ depend on a factor $0 \leq Th \leq 1$, which is based on the 10 ms frame energy and smoothed by a 5-tap median filter.

TABLE 3

G.729.1 Parameters of the Adaptive Postfilter Depending on Bit Rate

| Bit rate (kbit/s) | $\gamma_p$ | $\gamma_n$ | $\gamma_d$ |
|---|---|---|---|
| 8 | 0.5 | 0.55 | |
| 12 | | Th × 0.7 + (1 − Th) × 0.55 | Th × 0.75 + (1 − Th) × 0.7 |
| 14 and above | | 0.7 | 0.75 |

Post-Processing of the Decoded Higher Band

The post-processing of MDCT coefficients is only applied to the higher band because the lower band is post-processed with a conventional time-domain approach. For the high-band, there are no LPC coefficients transmitted to the decoder. The TDAC post-processing is performed on the available MDCT coefficients at the decoder side. There are 160 higher-band MDCT coefficients that are noted as $\hat{Y}(k)$, k=160, . . . , 319. For this specific post-processing, the higher band is divided into 10 sub-bands of 16 MDCT coefficients. The average magnitude in each sub-band is defined as the envelope:

$$env(j) = \sum_{k=0}^{15} |\hat{Y}(160 + 16j + k)|, \; j = 0, 1, \ldots, 9. \quad (15)$$

The post-processing consists of two steps. The first step is an envelope post-processing (corresponding to short-term post-processing), which modifies the envelope. The second step is a fine structure post-processing (corresponding to long-term post-processing), which enhances the magnitude of each coefficient within each sub-band. The basic concept is to make the lower magnitudes relatively further lower, where the coding error is relatively bigger than the higher magnitudes. The algorithm to modify the envelope is described as follows. The maximum envelope value is:

$$env_{max} = \max_{j=0,\ldots,9} env(j). \quad (16)$$

Gain factors, which will be applied to the envelope, are calculated with the equation:

$$fac_1(j) = \alpha_{ENV} \frac{env(j)}{env_{max}} + (1 - \alpha_{ENV}), \; j = 0, \ldots, 9, \quad (17)$$

where $\alpha_{ENV}$ ($0<\alpha_{ENV}<1$) depends on the bit rate. The higher the bit rate, the smaller the constant $\alpha_{ENV}$. After determining the factors $fac_1(j)$, the modified envelope is expressed as:

$$env'(j) = g_{norm} fac_1(j) env(j), \; j=0, \ldots, 9, \quad (18)$$

where $g_{norm}$ is a gain to maintain the overall energy:

$$g_{norm} = \frac{\sum_{k=0}^{9} env(j)}{\sum_{k=0}^{9} fac_1(j) env(j)}. \quad (19)$$

The fine structure modification within each sub-band will be similar to the above envelope post-processing. Gain factors for the magnitudes are calculated as:

$$fac_2(j, k) = \beta_{ENV} \frac{|\hat{Y}(160 + 16j + k)|}{Y_{max}(j)} + (1 - \beta_{ENV}), \; k = 0, \ldots, 15, \quad (20)$$

where the maximum magnitude $Y_{max}(j)$ within a sub-band is:

$$Y_{max}(j) = \max_{k=0,\ldots,15} |\hat{Y}(160 + 16j + k)|, \quad (21)$$

and $\beta_{ENV}$ ($0<\beta_{ENV}<1$) depends on the bit rate. Generally, the higher the bit rate, the smaller $\beta_{ENV}$. By combining both the envelope post-processing and the fine structure post-processing, the final post-processed higher-band MDCT coefficients are:

$$\hat{Y}^{post}(160+16j+k) = g_{norm} fac_1(j) fac_2(j,k) \hat{Y}(160+16j+k), \; j=0, \ldots, 9 \; k=0, \ldots, 15 \quad (22)$$

SUMMARY OF THE INVENTION

In an embodiment, a method is disclosed that corrects short pitch lag at a CELP decoder before doing pitch postprocessing using a corrected pitch lag. A transmitted pitch lag has a dynamic range including a minimum pitch limitation defined by a CELP algorithm. Pitch correlations of possible short pitch lags that are smaller than the minimum pitch limitation and have an approximated multiple relationship with the transmitted pitch lag are estimated. It is checked if one of the pitch correlations of the possible short pitch lags is large enough, compared to a pitch correlation estimated with the transmitted pitch lag. The short pitch lag is selected as a corrected pitch lag if its corresponding pitch correlation is large enough. The corrected pitch lag is used to do perform pitch postprocessing.

In an example, it is checked if the pitch correlation of one of possible short pitch lags in a previous frame or a previous subframe is large enough, before selecting the short pitch lag as the corrected pitch lag in a current frame or a current subframe.

In an example, it is detected if energy inside a very low frequency area $[0,F_{MIN}]$ related to the pitch dynamic range defined by said CELP algorithm is small enough prior to selecting the short pitch lag as the corrected pitch lag. $F_{MIN}$ is defined as $F_{MIN}=F_s/P_MIN$, P_MIN is the minimum pitch limitation defined by the CELP algorithm and $F_s$ is the sampling rate.

In an example, the pitch postprocessing includes any pitch enhancement and any periodicity enhancement as long as the parameter of pitch lag is needed in the enhancement at the decoder.

In an example, the pitch correlation at pitch lag P can be expressed as:

$$R(P) = \frac{\sum_n \hat{s}(n)\cdot\hat{s}(n-P)}{\sqrt{\sum_n \|\hat{s}(n)\|^2 \cdot \sum_n \|\hat{s}(n-P)\|^2}},$$

where $\hat{s}(n)$ is the CELP time domain output signal. To avoid the square root operation, the pitch correlation can be expressed as $R^2(P)$ and set to zero when $R(P)<0$. To reduce complexity, the denominator in the expression for R(P) can be omitted.

In an example, selecting the short pitch lag occurs according to the following mathematical expressions:
initial P is said transmitted pitch lag that can be replaced by $P_2$ or $P_m$ according to:

$$\text{if } (R(P_2) > C\cdot R(P)\ \&P_2 \approx \text{P_old}),\ P = P_2$$

$$\vdots$$

$$\text{if } (R(P_m) > C\cdot R(P)\ \&P_m \approx \text{P_old}),\ P = P_m,$$

where R(.) is the pitch correlation, $P_m$ is around P/m, m=2, 3, 4, . . . , $R(P_m)$ is the pitch correlation at the possible short pitch lag $P_m$, R(P) is the pitch correlation at transmitted pitch lag P, C is a constant coefficient smaller than 1 but may be close to 1, and P_old was updated in the previous frame. P_old is updated in the current frame prepared for the next frame according to:

$$\text{initial P_old} = \text{said transmitted pitch lag } P;$$

$$\text{if } (R(P_2) > C\cdot R(P)\ \&P_2 < \text{P_MIN}),\ \text{P_old} = P_2;$$

$$\vdots$$

$$\text{if } (R(P_m) > C\cdot R(P)\ \&P_m < \text{P_MIN}),\ \text{P_old} = P_m;$$

where P_MIN is said minimum pitch limitation defined by said CELP algorithm.

In another embodiment, a method of improving CELP postprocessing is disclosed. When the CELP output signal is mainly composed of said irregular harmonics, or the transmitted pitch lag does not represent a real pitch lag, the existence of said irregular harmonics or said wrong transmitted pitch lag is detected. Compared to a normal condition, more aggressive parameters for CELP postprocessing are set when the detection is confirmed.

In an example, CELP postprocessing uses a short-term CELP postfilter as defined in the equation (7). Parameters γn and γd of the short-term CELP postfilter are set to be more aggressive by making γn smaller and/or γd larger than the normal setting of standard codecs.

In an example, the parameters used to detect said existence of irregular harmonics or the wrong transmitted pitch lag may include: pitch correlation, pitch gain, or voicing parameters that are able to represent signal periodicity, spectral sharpness defined as a ratio between said average spectral energy level and said maximum spectral energy level in a specific spectrum region, and/or said spectral tilt.

In a further embodiment, CELP output perceptual quality is improved when the CELP output signal is music signal or it is mainly composed of irregular harmonics. The existence of music signal or irregular harmonics is detected. A CELP time domain output signal is transformed into the frequency domain, and frequency domain postprocessing is performed. Postprocessed frequency domain coefficients are inverse-transformed back into time domain.

The foregoing has outlined, rather broadly, features of the present invention. Additional features of the invention will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The features and advantages of the present invention will become more readily apparent to those ordinarily skilled in the art after reviewing the following detailed description and accompanying drawings, wherein.

Figure 1:
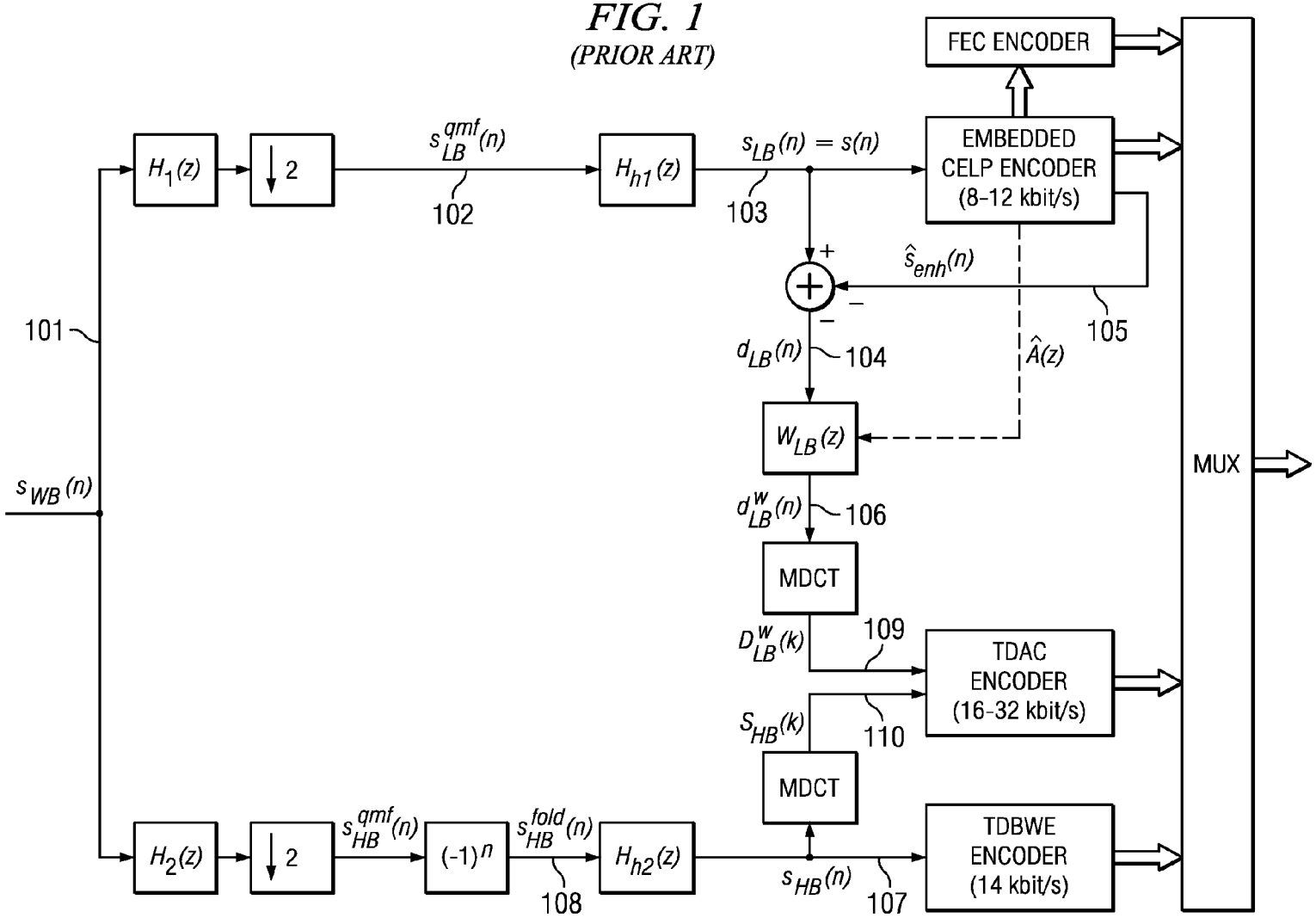
FIG. 1 (PRIOR ART)
FIG. 1 illustrates high-level block diagram of a prior-art ITU-T G.729.1 encoder.
Figure 2A:
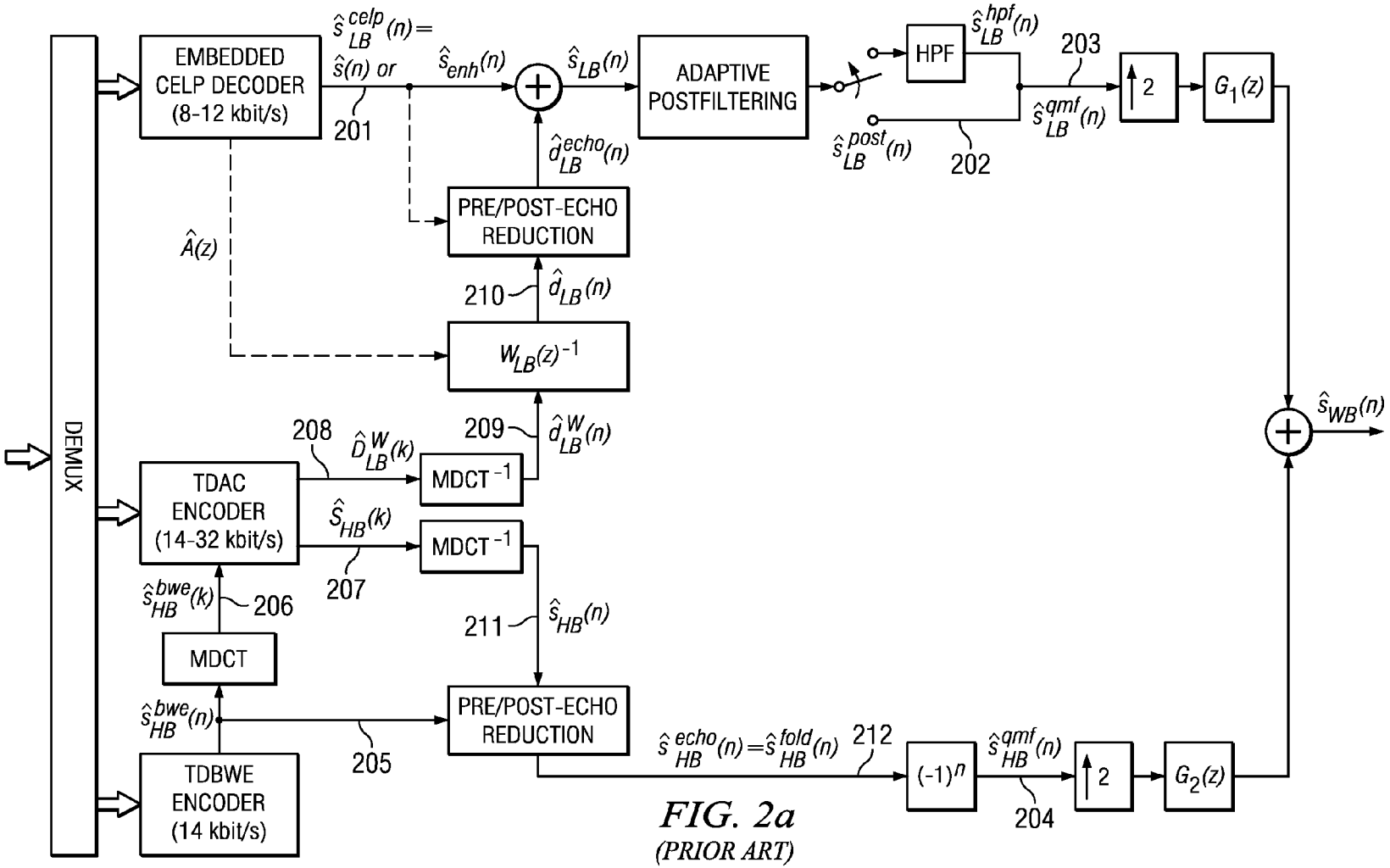
FIG. 2a (PRIOR ART)
FIG. 2*a* illustrates high-level block diagram of a prior-art G.729.1 decoder.
Figure 2B:
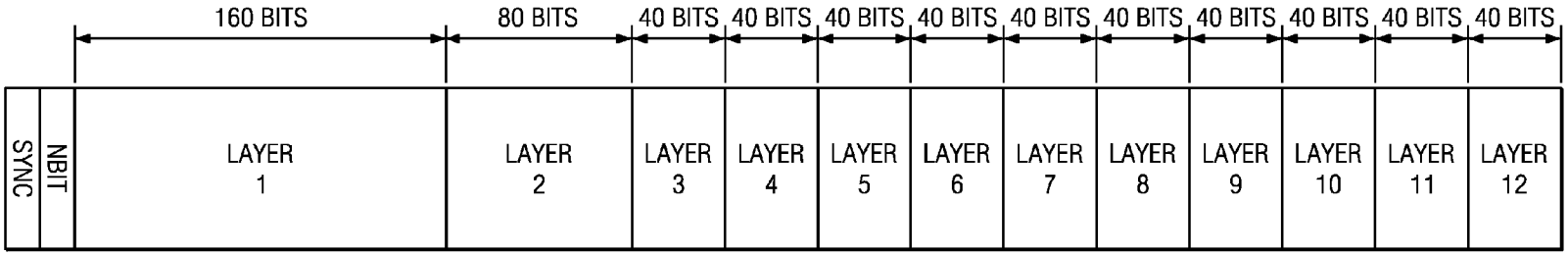
FIG. 2b (PRIOR ART)
FIG. 2*b* illustrates the bitstream format of G.729EV.

Corresponding numerals and symbols in different figures generally refer to corresponding parts unless otherwise indicated. The figures are drawn to clearly illustrate the relevant aspects of embodiments of the present invention and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

The present invention will be described with respect to embodiments in a specific context, namely a system and method for performing audio coding for telecommunication systems. Embodiments of this invention may also be applied to systems and methods that utilize speech and audio transform coding.

The CELP algorithm is a very popular technology that has been used in various ITU-T, MPEG, 3GPP, and 3GPP2 standards. CELP is primarily used to encode speech signal by using specific human voice characteristics or a human vocal voice production model. Most CELP codecs work well for normal speech signals; but often fail for music signals and/or singing voice signals. This phenomena also occurs with CELP based post-processing. CELP post-processing is normally realized by using short-term and long-term post-filters that are tuned to optimize the perceptual quality of normal voice signals. However, conventional CELP postfilters cannot be optimized for music signals and/or singing voice signals. Some scalable codecs such as ITU-T G.729.1/G.718 have adopted a CELP algorithm in the inner core layers. In these cases, the perceptual quality for both speech and music becomes important. In a recently developed standard of scalable G.729.1/G.718 super-wideband extensions, the G.729 CELP algorithm and the G.718 CELP algorithm have been adopted in the inner core layers where the CELP postfilters were originally tuned for normal voice signals and not for music signals or singing voice signals. Because the inner core layers were already standardized, it was required to maintain the interoperability of the standards when any higher layers are added. Therefore, it is desirable for a newly developed standard, which takes an existing standard as the inner core layer, to keep the original bitstream structure and definition of the inner core layer in order to maintain the interoperability with the existing standard. Under the condition of the interoperability, while it may be difficult to improve the CELP encoder, an embodiment CELP decoder can be modified to improve output quality when the higher layers are decoded.

Embodiments of the present invention improve CELP postprocessing in a number of ways: (1) when the real pitch lag is below the minimum limitation defined in CELP and transmitted pitch lag is much larger than real pitch lag, an embodiment short pitch lag correction can be efficiently performed before performing pitch postprocessing at decoder; (2) when the CELP output is mainly composed of irregular harmonics, an embodiment CELP postfilter is adaptively made more aggressive; and (3) when CELP output contains music, in an embodiment, the CELP time domain output signal is transformed into frequency domain to do more efficient frequency domain music postprocessing than time domain postprocessing. Advantages of embodiments that improve CELP postprocessing include the outcome that bitstream interoperability is not influenced, and postprocessing improvement does not come as a cost of extra bits.

It is understandable that CELP postprocessing works well for normal speech signals as it was tuned for normal speech signals; but that there could be problems for music signals or singing voice signals due to various reasons. For example, the integer open-loop pitch lag in G.729.1 core layer was designed in the dynamic range from 20 to 143. This pitch lag dynamic range adapts to most human voices, however, the real pitch lag of regular music or a singing voice signal can be much shorter than the minimum limitation such as P_MIN=20) defined in CELP algorithm. When the real pitch lag is P, the corresponding fundamental harmonic frequency is $F0=F_s/P$ where $F_s$ is sampling frequency and F0 is the location of first harmonic peak in spectrum. The minimum pitch limitation P_MIN, therefore, actually defines the maximum fundamental harmonic frequency limitation $F_{MIN}=Fs/P_MIN$ for the CELP algorithm.

Figure 3:
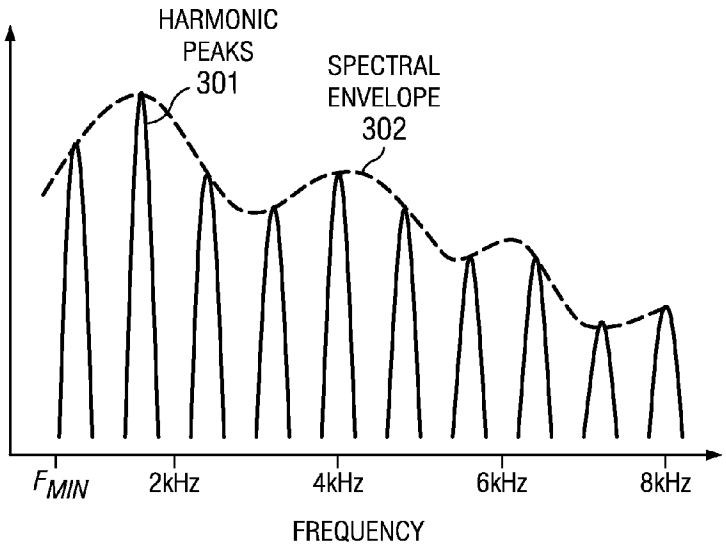
FIG. 3 illustrates an example of regular wideband spectrum.

In the example shown in FIG. 3, where 301 represent harmonic peaks and 302 is spectral envelope, the real fundamental harmonic frequency (the location of first harmonic peak) is already beyond the maximum fundamental harmonic frequency limitation $F_{MIN}$ so that the transmitted pitch lag for CELP algorithm is not able to equal to the real pitch lag. The transmitted pitch lag, in fact, could be a multiple of the real pitch lag. The wrong pitch lag transmitted with a multiple of the real pitch lag degrades sound quality.

Figure 5:
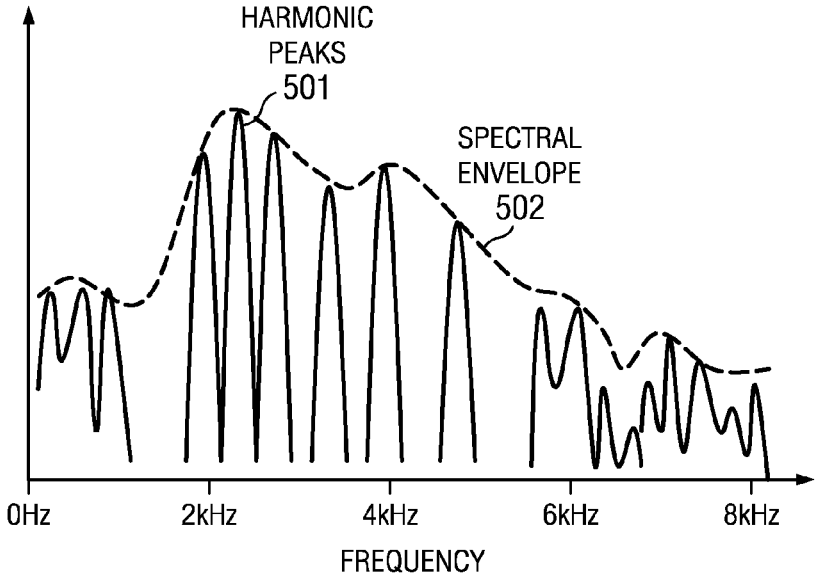
FIG. 5 illustrates an example of irregular harmonic wideband spectrum.

Music signals may contain irregular harmonics as shown in FIG. 5 where trace 501 represents harmonic peaks and trace 502 is a spectral envelope. Difficulties of the CELP algorithm to find right pitch lag for signal composed of irregular harmonics result in inefficient CELP coding. If CELP coding is inefficient, it is advantageous to set stronger postprocessing than normal conditions, as is done in embodiments of the present invention. For some signals composed of irregular harmonics, using postprocessing that is stronger than typically used for speech signals under normal conditions may still be not enough to compensate for the loss of quality. In embodiments of the present invention, CELP time domain output is transformed into frequency domain. Frequency domain postprocessing is then performed for music signal or singing voice signal. Embodiment system and methods of CELP based postprocessing for music signals or singing voice signals are further described as follows.

Correct Pitch Lag at Decoder for Pitch Postprocessing

Figure 4:
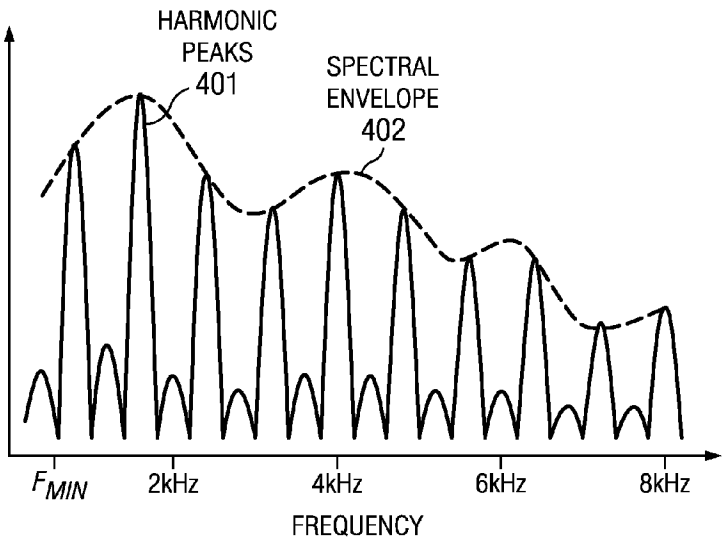
FIG. 4 illustrates an example of regular wideband spectrum after pitch-postfiltering with doubling pitch lag.

When real pitch lag for harmonic music signal or singing voice signal is smaller than the minimum lag P_MIN defined in CELP algorithm, the transmitted lag could be double or triple of the real pitch lag. As a result, the spectrum of the pitch-postfiltered signal with the transmitted lag could be as shown in FIG. 4 where 401 are harmonic peaks, 402 is spectral envelope and the unwanted small peaks between real harmonic peaks can be seen (assuming an ideal spectrum is represented in FIG. 3). The small spectrum peaks can cause uncomfortable perceptual distortion.

Usually, music harmonic signals or singing voice signals are more stationary than normal speech signals. Pitch lag (or fundamental frequency) of a normal speech signal keeps changing all the time. However, pitch lag (or fundamental frequency) of music signal or singing voice signal often is relatively slow changing for quite long time duration. Once the case of double or multiple pitch lag happens, it could last quite long time for music signal or a singing voice signal.

The following embodiment method corrects the pitch lag at CELP decoder before doing pitch-postprocessing which intends to enhance real harmonic peaks. Equation (1) gives an example of pitch-postprocessing. First, the normalized or un-normalized correlations of CELP output signals at distances of around the transmitted pitch lag, half (½) of the transmitted pitch lag, one third (⅓) of transmitted pitch lag, and even 1/m (m>3) of transmitted pitch lag are estimated, $$R(P) = \frac{\sum_n \hat{s}(n)\cdot\hat{s}(n-P)}{\sqrt{\sum_n \|\hat{s}(n)\|^2 \cdot \sum_n \|\hat{s}(n-P)\|^2}}. \tag{23}$$

Here, R(P) is a normalized pitch correlation with the transmitted pitch lag P. To avoid the square root in (23), the correlation can be expressed as $R^2(P)$ and by setting all negative R(P) values to zero. To reduce the complexity, the denominator of (23) can be omitted, for example, by setting the denominator equal to one. Suppose $P_2$ is an integer selected around P/2, which maximizes the correlation $R(P_2)$, $P_3$ is an integer selected around P/3, which maximizes the correlation $R(P_3)$, $P_3$ is an integer selected around P/m, which maximizes the correlation $R(P_m)$. If $R(P_2)$ or $R(P_m)$ is large enough compared to R(P), and if this phenomena lasts a certain time duration or happens for more than one decoding frame, P can be replaced by $P_2$ or $P_m$ before performing pitch-postprocessing:

$$\text{if } (R(P_2) > C \cdot R(P) \,\&P_2 \approx \text{P_old}),\ P = P_2$$

$$\vdots$$

$$\text{if } (R(P_m) > C \cdot R(P) \,\&P_m \approx \text{P_old}),\ P = P_m$$

where P_old is pitch candidate from previous frame and supposed to be smaller than P_MIN. P_old is updated for next frame:

$$\text{initial P_old} = P;$$

$$\text{if } (R(P_2) > C \cdot R(P) \,\&P_2 < \text{P_MIN}),\ \text{P_old} = P_2;$$

$$\vdots$$

$$\text{if } (R(P_m) > C \cdot R(P) \,\&P_m < \text{P_MIN}),\ \text{P_old} = P_m;$$

C is a weighting coefficient which is smaller than 1 but close to 1 for example, C<=0.95). If spectrum coefficients of decoded signal exist in decoder, the short pitch lag (<P_MIN) detection can be made more reliable by detecting if the energy in spectrum range $[0,F_{MIN}]$ is relatively small enough, as shown in FIG. 3 and FIG. 4, where $F_{MIN}$=FS/P_MIN and Fs is sampling rate.

In an embodiment of the present invention, short pitch lag is corrected at CELP decoder before doing pitch postprocessing, pitch enhancement, and periodicity enhancement, by using the corrected pitch lag. Correcting the pitch lag includes estimating pitch correlations of the possible short pitch lags that are smaller than the minimum pitch limitation defined by CELP algorithm, and have the approximated multiple relationship with transmitted pitch lag; checking if one of the pitch correlations of the possible short pitch lags is large enough compared with the pitch correlation estimated with the transmitted pitch lag; selecting the short pitch lag as the corrected pitch lag if its corresponding pitch correlation is large enough; and using the corrected pitch lag to do CELP pitch postprocessing. An embodiment method includes checking if the pitch correlation of one of the possible short pitch lags in a previous frame or a previous subframe is large enough, before selecting the short pitch lag as the corrected pitch lag in current frame or current subframe. An embodiment method further includes the step of detecting if the energy inside very low frequency area $[0,F_{MIN}]$ related to the pitch dynamic range defined by CELP algorithm is small enough, before selecting the short pitch lag as the corrected pitch lag, where $F_{MIN}=F_s$/P_MIN, P_MIN is the minimum pitch limitation defined by CELP algorithm and $F_s$ is the sampling rate.

Adaptive Short-Term Postfilter for Music Signals

Spectral harmonics of voiced speech signals are generally regularly spaced. The Long-Term Prediction (LTP) function in CELP works well for regular harmonics as long as the pitch lag is within the defined range. That is why ITU-T G.729.1 defines a weak short-term postfilter (see the equation (7)) with less aggressive parameters (γn=0.7 and γd=0.75) for the higher layers. However, music signals may contain irregular harmonics as illustrated in FIG. 5. In the case of irregular harmonics, the LTP function in CELP may not work well, resulting in poor music quality. One of the ways of improving the music quality at the decoder is to adaptively make the short-term postfilter more aggressive, which means γn is smaller and/or γd is larger. In embodiments of the present invention, some kind of detection, which shows CELP fails for music signals, is used before determining the short-term postfilter parameters. In order to detect the music signals of irregular harmonics, at least one of the following parameters can be used: pitch contribution or pitch gain, spectral sharpness and spectral tilt.

Pitch Contribution or Pitch Gain

If pitch contribution or LTP gain is high enough, it means CELP is successful and it is not necessary to make the short-term postfilter more aggressive in embodiments of the present invention. Otherwise, the signal is checked whether it contains harmonics. If the signal is harmonic and the pitch contribution is low, the short-term postfilter is made more aggressive. The CELP excitation includes an adaptive codebook component (pitch contribution component) and fixed codebook components (fixed codebook contributions). As an example, the energy of the fixed codebook contributions for G.729.1 is noted as:

$$E_c = \sum_{n=0}^{39} (\hat{g}_c \cdot c(n) + \hat{g}_{enh} \cdot c'(n))^2, \tag{24}$$

and the energy of the adaptive codebook contribution is noted as:

$$E_p = \sum_{n=0}^{39} (\hat{g}_p \cdot v(n))^2. \tag{25}$$

One of the following relative ratios or other ratios between $E_c$ and $E_p$, named voicing parameters, is used to measure the pitch contribution:

$$\xi_1 = \frac{E_p}{E_c}, \tag{26}$$

$$\xi_2 = \frac{E_p}{E_c + E_p}, \tag{27}$$

$$\xi_3 = \sqrt{\frac{E_p}{E_c}}, \tag{28}$$

$$\xi_4 = \sqrt{\frac{E_p}{E_c + E_p}}, \text{ and} \tag{29}$$

$$\xi_5 = \frac{\sqrt{E_p}}{\sqrt{E_c} + \sqrt{E_p}}. \tag{30}$$

Normalized pitch correlation in (23) can be also a measuring parameter.

Spectral Sharpness

Spectral Sharpness is mainly measured on the spectral subbands. It is defined as a ratio between the largest coefficient and the average coefficient magnitude in one of the subbands:

$$P_1 = \frac{\text{Max}\{|MDCT_i(k)|, k = 0, 1, 2, \ldots N_i - 1\}}{\frac{1}{N} \cdot \sum_k |MDCT_i(k)|}, \quad (30)$$

where $MDCT_i(k)$ is MDCT coefficients in the i-th frequency subband, $N_i$ is the number of MDCT coefficients of the i-th subband. Usually the "sharpest" (largest) ratio $P_1$ among the subbands is used as the measuring parameter. The spectral sharpness can also be defined as $1/P_1$. An average sharpness of the spectrum can also be used as the measuring parameter. Of course, the spectrum sharpness could be measured in DFT, FFT or MDCT frequency domain. If the spectrum is "sharp" enough, it means that harmonics exist. If the pitch contribution of CELP codec is low and the signal spectrum is "sharp," the CELP short-term postfilter is made more aggressive in some embodiments.

Spectral Tilt

Spectral tile can be measured in the time domain or the frequency domain. If it is measured in the time domain, the tilt is expressed as:

$$\text{Tilt1} = \frac{\sum_n \hat{s}(n) \cdot \hat{s}(n-1)}{\sum_n \|\hat{s}(n)\|^2}, \quad (31)$$

where $\hat{s}(n)$ is a CELP output signal. This tilt parameter can be simply represented by the first reflection coefficient from LPC parameters. If the tilt parameter is estimated in frequency domain, it may be expressed as:

$$\text{Tilt2} = \frac{E_{high_band}}{E_{low_band}}, \quad (32)$$

where $E_{high_band}$ represents high band energy, and $E_low__{band}$ reflects low band energy. If the signal contains much more energy in low band than in high band when the pitch contribution is very low, the CELP short-term postfilter is made more aggressive in embodiments of the present invention. All above parameters can be performed in a form called running mean which takes some kind of average smoothing of recent parameter values, and/or they could be measured by counting the number of the small parameter values or large parameter values.

An embodiment method improves CELP postprocessing when CELP output signal is mainly composed of irregular harmonics, or when the transmitted pitch lag does not represent real pitch lag. The method detects the existence of irregular harmonics or wrong transmitted pitch lag, sets more aggressive parameters for CELP postprocessing than in a normal condition, when the detection is confirmed. The short-term CELP postfilter, which is defined in the equation (7) hereinabove, is an example CELP postprocessing, where the parameters $\gamma n$ and $\gamma d$ of the short-term CELP postfilter are set more aggressive by making $\gamma n$ smaller and/or $\gamma d$ larger. Embodiment parameters used to detect the existence of irregular harmonics or wrong transmitted pitch lag may include: pitch correlation, pitch gain, or voicing parameters that are able to represent signal periodicity. Parameters also include spectral sharpness, which is the ratio between average spectral energy level and maximum spectral energy level in specific spectrum region, and/or a spectral tilt parameter that can be measured in time domain or frequency domain.

Transform Time Domain Output Signal into Frequency Domain

For signals with irregular harmonics, the CELP pitch-postfilter may not work well because it was designed to enhance regular harmonics. If the complexity is allowed, embodiments of the present invention transform the time-domain output signal into frequency domain (or MDCT domain). A frequency domain postprocessing approach (similar to or different from the one used in G.729.1) is used to enhance any kind of irregular harmonics.

An embodiment method improves CELP output perceptual quality when the CELP output signal is a music signal or it is mainly composed of irregular harmonics. The method includes detecting the existence of music signal or irregular harmonics, transforming CELP time domain output signal into frequency domain, performing frequency domain postprocessing, and inverse-transforming postprocessed frequency domain coefficients back into time domain.

Figure 6:
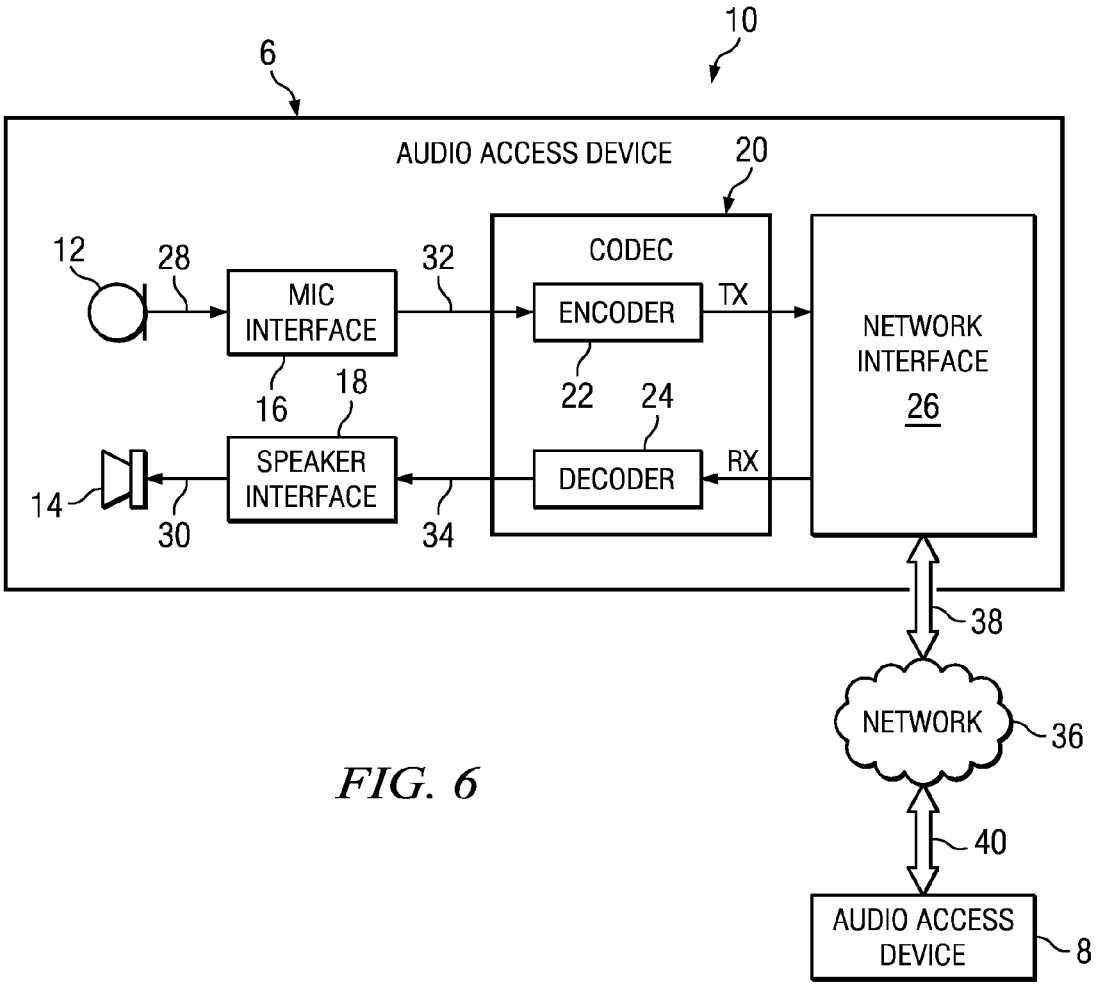
FIG. 6 illustrates a communication system according to an embodiment of the present invention.

FIG. 6 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VoIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VoIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the improvement of CELP postprocessing for music signals or singing voice signals. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. The drawings in the present application and their accompanying detailed description are directed to merely example embodiments of the invention. To maintain brevity, other embodiments of the invention that use the principles of the present invention are not specifically described in the present application and are not specifically illustrated by the present drawings.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacture, compositions of matter, means, methods, or steps.

What is claimed is:

1. A method of receiving a decoded audio signal comprising a transmitted pitch lag, the method comprising:

estimating pitch correlations of possible short pitch lags that are smaller than a minimum pitch limitation and have an approximated multiple relationship with the transmitted pitch lag;

checking if one of the pitch correlations of the possible short pitch lags is large enough compared to a pitch correlation estimated with the transmitted pitch lag;

selecting a short pitch lag as a corrected pitch lag if a corresponding pitch correlation is large enough; and perform pitch related postprocessing using the corrected pitch lag.

2. The method of claim 1, wherein:

postprocessing is included in a code-excited linear prediction (CELP) decoder; and the transmitted pitch lag comprises a dynamic range including a minimum pitch limitation defined by a CELP algorithm.

3. The method of claim 1, further comprising:

before selecting the short pitch lag as the corrected pitch lag in a current frame or a current subframe, checking if one of the pitch correlations of the possible short pitch lags in a previous frame or a previous subframe is large enough.

4. The method of claim 1, further comprising:

before selecting the short pitch lag as the corrected pitch lag, detecting if energy inside a very low frequency area $[0,F_{MIN}]$ related to a pitch dynamic range defined by a code-excited linear prediction (CELP) algorithm is small enough, where $F_{MIN}=F_s/P_MIN$ , P_MIN is said minimum pitch limitation defined by the CELP algorithm, and $F_s$ is said sampling rate.

5. The method of claim 1, wherein:

the pitch related postprocessing includes pitch enhancement or periodicity enhancement; and the pitch related postprocessing uses pitch lag as a parameter.

6. The method of claim 1, wherein a pitch correlation is expressed as, $$R(P) = \frac{\sum_n \hat{s}(n)\cdot\hat{s}(n-P)}{\sqrt{\sum_n \|\hat{s}(n)\|^2 \cdot \sum_n \|\hat{s}(n-P)\|^2}}$$

where ŝ(n) is a code-excited linear prediction (CELP) time domain output signal and P is the transmitted pitch lag or the possible short pitch lags.

7. The method of claim 6, wherein the pitch correlation is further expressed as $R^2$ (P) and set to zero when R(P)<0 to reduce the complexity, or the denominator of R(P) is omitted.

8. The method of claim 1, wherein said selecting the short pitch lag comprises:

evaluating the following expression where initial P is a transmitted pitch lag that is replaced by $P_2$ or $P_m$ according to the following condition:

$$\text{if } (R(P_2) > C\cdot R(P)\ \&P_2 \approx \text{P_old}),\ P = P_2$$

$$\vdots$$

$$\text{if } (R(P_m) > C\cdot R(P)\ \&P_m \approx \text{P_old}),\ P = P_m$$

where R(.) is the pitch correlation, $P_m$ is around P/m, m=2,3,4, . . . , $R(P_m)$ is the pitch correlation at the possible short pitch lag $P_m$, R(P) is the pitch correlation at transmitted pitch lag P, C is a constant coefficient that is smaller than 1 but may be close to 1, P_old is a short pitch lag updated in a previous frame; and P_old is updated in a current frame and prepared for a next frame according to the expression:

$$\text{initial P_old} = \text{said transmitted pitch lag } P;$$

$$\text{if } (R(P_2) > C\cdot R(P)\ \&P_2 < \text{P_MIN}),\ \text{P_old} = P_2;$$

$$\vdots$$

$$\text{if } (R(P_m) > C\cdot R(P)\ \&P_m < \text{P_MIN}),\ \text{P_old} = P_m;$$

where P_MIN is the minimum pitch limitation defined by the CELP algorithm.

9. The method of claim 1, further comprising producing an output audio signal based on the postprocessing with the corrected pitch lag.

10. The method of claim 9, further comprising driving a loudspeaker with the output audio signal.

11. The method of claim 1, wherein receiving comprises receiving over a voice over internet protocol (VOIP) network.

12. The method of claim 1, wherein receiving comprises receiving over a cellular telephone network.

13. A method of receiving an audio signal decoded from a coded-excited linear prediction (CELP) decoder comprising a transmitted pitch lag, the method comprising:

postprocessing the audio signal, the postprocessing comprising using parameters, wherein postprocessing further comprises using a short-term CELP postfilter defined as:

$$H_f(z) = \frac{1}{g_f}\frac{\hat{A}(z/\gamma_n)}{\hat{A}(z/\gamma_d)} = \frac{1}{g_f}\frac{1+\sum_{i=1}^{10}\gamma_n^i\hat{a}_i z^{-1}}{1+\sum_{i=1}^{10}\gamma_d^i\hat{a}_i z^{-i}},$$

where said parameters $\gamma_n$ and $\gamma_d$ are set more aggressively by making $\gamma_n$ smaller and/or $\gamma_d$ larger;

detecting irregular harmonics in an output of the CELP decoder;

detecting a wrong transmitted pitch lag; and setting the parameters to more aggressive values if irregular harmonics or the wrong transmitted pitch lag is detected, wherein the more aggressive values are more aggressive than values used in a normal condition.

14. The method of claim 13, wherein detecting irregular harmonics comprises using parameters to detect irregular harmonics, the parameters comprising: pitch correlation, pitch gain, voicing parameters configured to represent signal periodicity; spectral sharpness comprising a ratio between an average spectral energy level and a maximum spectral energy level in a specific spectrum region, and/or spectral tilt.

15. The method of claim 13, wherein detecting the wrong transmitted pitch lag comprises using parameters to detect the wrong transmitted pitch lag , the parameters comprising: pitch correlation, pitch gain, voicing parameters configured to represent signal periodicity; spectral sharpness comprising a ratio between an average spectral energy level and a maximum spectral energy level in a specific spectrum region, and/or spectral tilt.

16. A system for receiving a decoded audio signal comprising a transmitted pitch lag, the system comprising:

a receiver configured to receive the decoded audio signal, the receiver configured to:

estimating pitch correlations of possible short pitch lags that are smaller than a minimum pitch limitation and have an approximated multiple relationship with the transmitted pitch lag;

check if one of the pitch correlations of the possible short pitch lags is large enough compared to a pitch correlation estimated with the transmitted pitch lag;

select a short pitch lag as a corrected pitch lag if a corresponding pitch correlation is large enough;

perform pitch related postprocessing using the corrected pitch lag; and produce an output audio signal based on the pitch related postprocessing using the corrected pitch lag.

17. The system of claim 16, wherein the receiver is further configured to be coupled to a voice over internet protocol (VOIP) network.

18. The system of claim 16, wherein the receiver is further configured to be coupled to a mobile telephone network.

19. The system of claim 16, wherein the output audio signal is configured to be coupled to a loudspeaker.

20. The system of claim 16, wherein the receiver comprises a CELP decoder.

* * * * *

UNITED STATES PATENT AND TRADEMARK OFFICE

CERTIFICATE OF CORRECTION

PATENT NO. : 8,577,673 B2
APPLICATION NO. : 12/559739
DATED : November 5, 2013
INVENTOR(S) : Yang Gao It is certified that error appears in the above-identified patent and that said Letters Patent is hereby corrected as shown below:

In the Specification

In Col. 2, line 14, Background – G729.1 Encoder, delete "$s_{LB}^{qmf}(n)$" and insert -- $s_{LB}^{qmf}(n)$ --.

In Col. 2, line 26, Background – G729.1 Encoder, delete "$d_{LB}^{w}(n)$" and insert -- $d_{LB}^{w}(n)$ --.

In Col. 2, line 27, Background – G729.1 Encoder, delete "$d_{LB}^{w}(n)$" and insert -- $d_{LB}^{w}(n)$ --.

In Col. 2, line 29, Background – G729.1 Encoder, delete "$s_{HB}^{fold}(n)$" and insert -- $s_{HB}^{fold}(n)$ --.

In Col. 2, line 34, Background – G729.1 Encoder, delete "$D_{LB}^{w}(k)$" and insert -- $D_{LB}^{w}(k)$ --.

In Col. 2, line 49, Background – G729.1 Decoder, delete "$\hat{s}_{LB}^{post}(n)$" and insert -- $\hat{s}_{LB}^{post}(n)$ --.

In Col. 2, line 51, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$ --.

In Col. 2, line 53, Background – G729.1 Decoder, delete "$\hat{s}_{HB}^{qmf}(n)$" and insert -- $\hat{s}_{HB}^{qmf}(n)$ --.

In Col. 2, line 58, Background – G729.1 Decoder, delete "$\hat{s}_{LB}^{post}(n)$" and insert -- $\hat{s}_{LB}^{post}(n)$ --.

In Col. 2, line 59, Background – G729.1 Decoder, delete "$\hat{s}_{LB}^{qmf}(n) = \hat{s}_{LB}^{hpf}(n)$" and insert -- $\hat{s}_{LB}^{qmf}(n) = \hat{s}_{LB}^{hpf}(n)$ --.

In Col. 2, line 61, Background – G729.1 Decoder, delete "$\hat{s}_{HB}^{qmf}(n)$" and insert -- $\hat{s}_{HB}^{qmf}(n)$ --.

In Col. 2, line 65, Background – G729.1 Decoder, delete "$\hat{s}_{HB}^{bwe}(n)$" and insert -- $\hat{s}_{HB}^{bwe}(n)$ --.

In Col. 3, line 1, Background – G729.1 Decoder, delete "$\hat{S}_{HB}^{bwe}(k)$" and insert -- $\hat{S}_{HB}^{bwe}(k)$ --.

In Col. 3, line 5, Background – G729.1 Decoder, delete "$\hat{s}_{HB}^{qmf}(n)$" and insert -- $\hat{s}_{HB}^{qmf}(n)$ --.

In Col. 3, line 6, Background – G729.1 Decoder, delete "$\hat{s}_{LB}^{qmf}(n) = \hat{s}_{LB}^{post}(n)$" and insert -- $\hat{s}_{LB}^{qmf}(n) = \hat{s}_{LB}^{post}(n)$ --.

In Col. 3, line 11, Background – G729.1 Encoder, delete "$\hat{D}_{LB}^{w}(k)$" and insert -- $\hat{D}_{LB}^{w}(k)$ --.

Signed and Sealed this
Eleventh Day of February, 2014

Michelle K. Lee

Michelle K. Lee
*Deputy Director of the United States Patent and Trademark Office*

In Col. 3, line 18, Background – G729.1 Decoder, delete "$\hat{S}_{HB}^{bwe}(k)$. Both $\hat{D}_{LB}^{w}(k)$" and insert -- $\hat{S}_{HB}^{bwe}(k)$. Both $\hat{D}_{LB}^{w}(k)$--.

In Col. 3, line 20, Background – G729.1 Encoder, delete "$\hat{d}_{LB}^{w}(n)$" and insert -- $\hat{d}_{LB}^{w}(n)$ --.

In Col. 3, line 26, Background – G729.1 Decoder, delete "$\hat{s}_{HB}^{fold}(n)$" and insert -- $\hat{s}_{HB}^{fold}(n)$ --.

In Col. 3, line 27, Background – G729.1 Decoder, delete "$\hat{s}_{LB}(n) = \hat{s}_{LB}^{post}(n)$ and $\hat{s}_{HB}^{qmf}(n)$" and insert -- $\hat{s}_{LB}^{qmf}(n) = \hat{s}_{LB}^{post}(n)$ and $\hat{s}_{HB}^{qmf}(n)$--.

In Col. 3, line 37, Background – Coder Modes, insert a --.-- after "filterbanks".

In Col. 4, line 12, Background – Coder Modes, delete "NB INPUT" and insert --NB_INPUT--.

In Col. 4, line 15, Background – Coder Modes, delete "G729 BST" and insert --G729_BST--.

In Col. 4, line 18, Background – Coder Modes, delete "NB INPUT" and insert --NB_INPUT--.

In Col. 8, line 30, Background – Post-Filtering of the Lower Band, delete "$\gamma_t k_1'$ is a tilt factor $k_1'$" and insert -- $\gamma_t k_1'$ is a tilt factor $k_1'$ --.

In Col. 8, lines 35-36, Background – Post-Filtering of the Lower Band, delete "$k_1' = -\frac{r_h(1)}{r_h(0)} \quad r_h(i) = \sum_{j=0}^{19-i} h_f(j) h_f(j+1)$" and insert -- $k_1' = -\frac{r_h(1)}{r_h(0)} \quad r_h(i) = \sum_{j=0}^{19-i} h_f(j) h_f(j+i)$ --.

In Col. 8, line 38, Background – Post-Filtering of the Lower Band, delete "$g_t = 1 - |\gamma_t k_1'|$" and insert -- $g_t = 1 - |\gamma_t k_1'|$ --.

In Col. 8, line 41, Background – Post-Filtering of the Lower Band, delete "$k_1'$. If $k_1'$" and insert -- $k_1'$. If $k_1'$ --.

In Col. 8, line 42, Background – Post-Filtering of the Lower Band, delete "$k_1'$" and insert -- $k_1'$ --.

In Col. 15, line 4, Detailed Description of Illustrative Embodiments – Correct Pitch Lag at Decoder for Pitch Postprocessing, delete "$P_3$" and insert --$P_m$--.

In Col. 15, line 36, Detailed Description of Illustrative Embodiments – Correct Pitch Lag at Decoder for Pitch Postprocessing, delete "$F_{MIN}$=*FS/P_MIN* and *Fs*" and insert --$F_{MIN}$=*Fs/P_MIN* and *Fs*--.

In Col. 17, lines 1-3, Detailed Description of Illustrative Embodiments – Spectral Sharpness, delete "$P_1 = \frac{Max\{|MDCT_i(k)|, \quad k = 0,1,2,....N_i - 1\}}{\frac{1}{N} \cdot \sum_k |MDCT_i(k)|}$" and insert -- $P_1 = \frac{Max\{|MDCT_i(k)|, \quad k = 0,1,2,....N_i - 1\}}{\frac{1}{N_i} \cdot \sum_k |MDCT_i(k)|}$ --.

In Col. 17, line 42, Detailed Description of Illustrative Embodiments – Spectral Tilt, delete "E_low_band" and insert --$E_{low_band}$--.

In Col. 18, line 26, Detailed Description of Illustrative Embodiments – Transform Time Domain Output Signal into Frequency Domain, delete "(VoIP)" and insert --(VOIP)--.